US007084363B1

(12) United States Patent
Niedermeyer

(10) Patent No.: US 7,084,363 B1
(45) Date of Patent: Aug. 1, 2006

(54) VARIABLE DIFFERENTIAL ADJUSTOR

(75) Inventor: Karl Niedermeyer, Bensenville, IL (US)

(73) Assignee: Trusty Warns, Inc., Wooddale, IL (US)

( * ) Notice: Subject to any disclaimer, the term of this patent is extended or adjusted under 35 U.S.C. 154(b) by 77 days.

(21) Appl. No.: 10/732,644

(22) Filed: Dec. 10, 2003

(51) Int. Cl.
*H01H 36/36* (2006.01)

(52) U.S. Cl. ..... 200/81 R; 200/61.04; 200/81.8; 73/861.42; 340/605; 340/626

(58) Field of Classification Search ..... 200/81 R, 200/82 R, 81.6, 81.8, 81.9 R, 191, 52 R, 200/61.04; 73/861.08, 861.42, 861.44, 239, 73/242; 340/626, 603, 605
See application file for complete search history.

(56) References Cited

U.S. PATENT DOCUMENTS 4,278,856 A * 7/1981 Owens ..... 200/82 R
5,155,310 A * 10/1992 Goans ..... 200/82 R
5,478,977 A * 12/1995 Beasley ..... 200/82 E
5,672,049 A * 9/1997 Ciurlo ..... 417/44.1
6,472,624 B1 * 10/2002 Harris et al. ..... 200/81.9 R
6,495,777 B1 * 12/2002 Chou ..... 200/83 R

* cited by examiner

*Primary Examiner*—Richard K. Lee
(74) *Attorney, Agent, or Firm*—Barnes & ThornburgLLP

(57) ABSTRACT

A variable differential adjustor for a fluid pressure-actuated switch, with the fluid, in the preferred form of the invention, being air. The restrictor has a restrictor housing with a fluid passage in which a restrictor plug, typically a set screw, is engaged. By judicious adjustment of the position of the set screw, fluid flow to and from a pressure-actuated switch is controlled, controlling when the switch is activated to control apparatus such as a sump pump, and when the switch is deactivated.

9 Claims, 2 Drawing Sheets

VARIABLE DIFFERENTIAL ADJUSTOR

BACKGROUND OF THE INVENTION

This invention relates to fluid control, and in particular to a variable differential adjustor for a fluid pressure-actuated switch, with the fluid, in the preferred form, being air.

In dwellings and other structures using sump pumps to drain subterranean building footings and avoid ingress of water into the structure, it is important that the sump pump be actuated when water removal limits occur. Thus, sump pumps have switches that are activated by many different types of actuation devices, such as floats, pressure pads, and pressure tubes. It is the latter type of structure that is utilized with the invention of the present application.

Pressure tubes typically extend into a sump pit or other water collection area, and as water rises in the sump pit, pressure within the tube increases until a pressure-actuated switch is closed, thus activating the sump pump. Once the water level is reduced below a certain level by the sump pump, the pressure-actuated switch is deactivated, and pumping ceases.

To control the level at which pumping begins, typically the tube is repositioned up or down, which then translates into a higher or lower water level which commences actuation of the sump pump. If repositioning of the pressure tube is impossible or inconvenient, then the only manner in which to change the actuation of a pressure-actuated switch would be to restrict air pressure to the switch, effectively delaying actuation of the switch.

SUMMARY OF THE INVENTION

The invention is directed to a variable differential adjustor for a fluid pressure-actuated switch. A restrictor housing is provided, having a fluid passage therethrough. A connection of the restrictor housing is provided to the pressure-actuated switch for directing fluid pressure to and from the restrictor housing for activation of the pressure-actuated switch. A restrictor plug, shaped to engage the fluid passage, is positionable in the fluid passage to alter fluid flow through the fluid passage to the pressure-actuated switch.

In the preferred form of the invention, air is the fluid, and the fluid passage comprises a bore. The restrictor plug comprises an element which is adjustable in the bore. Preferably, that element is a set screw which is threadedly engaged in the bore. The bore typically is smooth and the set screw is engaged with threaded peaks of the set screw, leaving a helical fluid passage between the set screw and the bore for fluid flow.

The restrictor housing is preferably a hollow tube junction in tubing leading from a pressure tube to a pressure-actuated switch for a sump pump. The set screw is threadedly engaged in a smooth bore in the tube junction.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
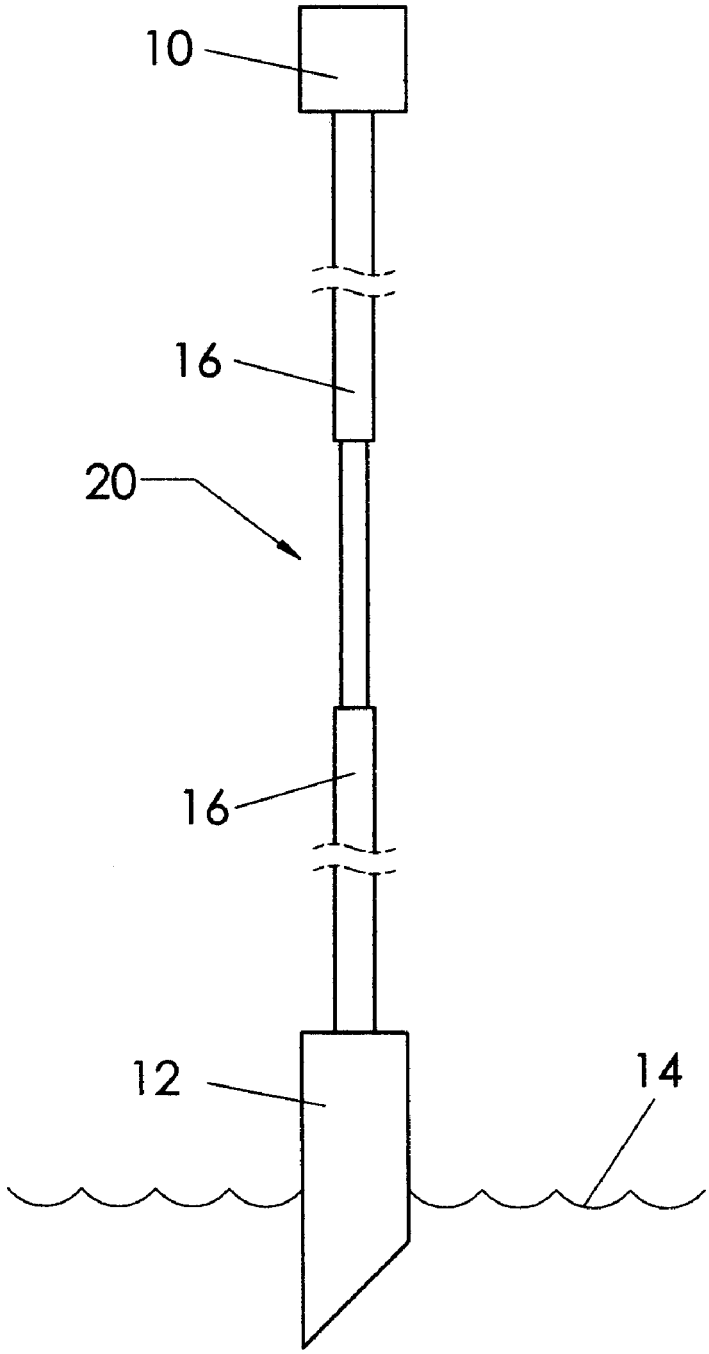
FIG. 1 is an elevational view of pressure-actuated switch connected to a pressure tube, with the variable differential adjustor of the invention interposed between the pressure tube and the pressure-actuated switch.

FIG. 1 illustrates a typical arrangement for activating a fluid-actuated switch 10, which, in turn, activates a sump pump or similar device (not illustrated). The pressure-actuated switch may be a conventional switch well known to those skilled in the art. Air, in the preferred form of the invention, is the fluid that is used for switch actuation.

A pressure tube 12 extends to sump pit or other water collection area, and as the level of the water 14 rises or falls, air pressure within the pressure tube 12 changes commensurately. That pressure is communicated to the pressure-actuated switch by means of hollow tubing 16.

Figure 2:
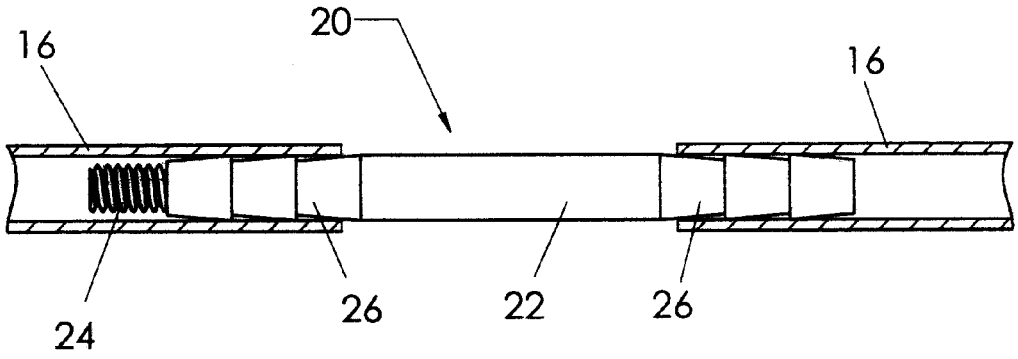
FIG. 2 is an enlarged view, partially in cross section, of a variable differential adjustor according to the invention, installed between two pieces of tubing.
Figure 3:
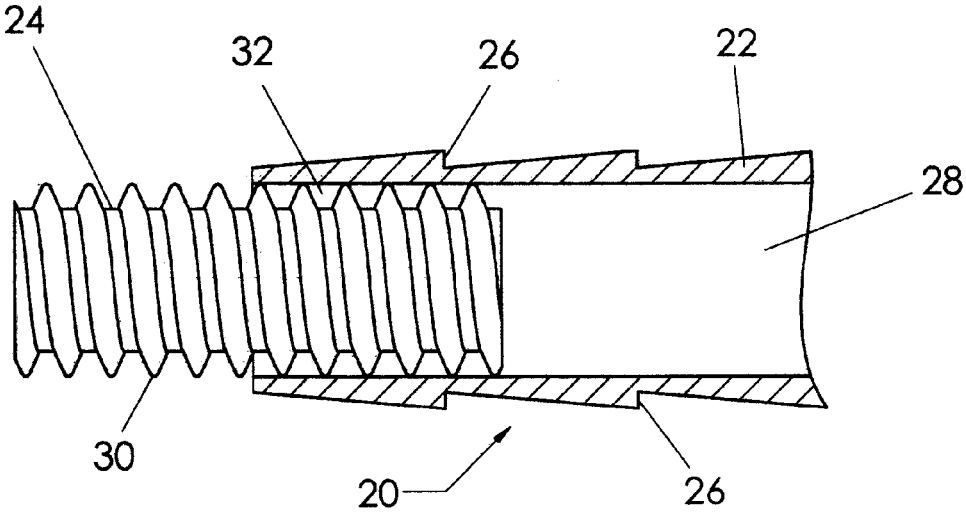
FIG. 3 is a further enlarged cross sectional view of a portion of the variable differential adjustor according to the invention, showing installation of the set screw in greater detail.

To control transmission of fluid pressure from the pressure tube 12 to the switch 10, a variable differential adjustor 20 according to the invention is installed in the tubing 16. As best illustrated in FIGS. 2 and 3, the variable differential adjustor 20 comprises two basic elements, a restrictor housing 22 and a restrictor plug 24.

The restrictor housing preferably comprises a hollow tube junction which joins portions of the tubing 16. The restrictor housing has a series of exterior barbs 26 on each end which lodge the restrictor in place when forced within the tubing 16.

The restrictor housing 22 has a fluid passage in the form of a bore 28. Thus, if the restrictor plug 24 were not present, the bore 28 would form an unrestricted connection between two portions of the tubing 16.

The restrictor plug 24 is shaped to engage the bore 28. Preferably the restrictor plug 24 is a set screw, having a helical thread 30 which engages in the bore 28. The set screw forming the restrictor plug 24 can be conventional, and has thread peaks engaging the bore 28, leaving a helical fluid passage 32 between the set screw and the bore 28. The helical fluid passage 32 thus becomes a restricted passage to control pressure transmission through the variable differential adjustor 20.

Again viewing FIG. 1, by judicious adjustment of the set screw in the bore 28, the buildup or reduction of pressure in the upper portion of the tubing 16 to the pressure actuated switch 10 is controlled. That, then, can change the level of the water 14 at which the pressure-actuated switch 10 is activated and also the level at which the pressure-actuated switch is deactivated. For example, if, typically, a four-inch difference in the water level 14 would normally be the on and off positions of the switch 10 without utilization of the variable differential adjustor 20, with installation of the variable differential adjustor 20, that can be changed dramatically, depending on how deeply the set screw of the restrictor plug 24 is installed in the bore 28. The greater the depth of installation in the bore 28, the slower pressure builds in the upper portion of the tubing 16 (and, conversely, diminishes as the water level drops), thus quite variably changing the effective on and off water levels in a sump pit or other water collection area being monitored.

The invention, while simple, provides a dependable and widely adjustable restrictor, which is not temperature dependent. Various changes can be made to the invention without departing from the spirit thereof or scope of the following claims.

What is claimed is:

1. A variable differential adjustor for a fluid pressure-actuated switch, comprising a. a restrictor housing having a fluid passage therethrough, b. a connection for connecting said restrictor housing to the pressure-actuated switch for directing fluid to and from said restrictor housing for activation of the pressure-actuated switch, and c. a restrictor plug shaped to engage said fluid passage, said restrictor plug being positionable to variably alter fluid flow through said fluid passage.

2. The variable differential adjustor according to claim 1, in which said fluid passage comprises a bore, and said restrictor plug comprises an element adjustable in said bore.

3. The variable differential adjustor according to claim 2, in which said element comprises a set screw threadedly engaged in said bore.

4. The variable differential adjustor according to claim 3, in which said bore is smooth and said set screw is engaged with thread peaks, leaving a helical fluid passage between said set screw and said bore.

5. The variable differential adjustor according to claim 1, in which said restrictor housing comprises a hollow tube junction, and said restrictor plug comprises a set screw threadedly engaged in said tube junction.

6. The variable differential adjustor according to claim 1, in which said connection comprises a tube extending between said restrictor housing and the pressure-actuated switch.

7. A variable differential adjustor for a fluid pressure-actuated switch, comprising a. a restrictor housing having a cylindrical fluid passage therethrough, b. a tube extending between said restrictor housing and the pressure-actuated switch for directing fluid to and from said restrictor housing for activation of the pressure-actuated switch, and c. a set screw threadedly engaged in said fluid passage, said set screw being positionable to variably alter fluid flow through said fluid passage.

8. The variable differential adjustor according to claim 7, in which said fluid passage is smooth and said set screw is engaged with thread peaks, leaving a helical fluid passage between said set screw and said fluid passage.

9. The variable differential adjustor according to claim 7, in which said restrictor housing comprises a hollow tube junction joining said tube to a pressure detector.

* * * * *